US005427122A

United States Patent [19]

Hamilton

[11] Patent Number: 5,427,122

[45] Date of Patent: Jun. 27, 1995

[54] HAIR-CUTTING GUIDE

[76] Inventor: Paul M. Hamilton, 15 Oak Ave., West Newton, Mass. 02165

[21] Appl. No.: 254,152

[22] Filed: Jun. 6, 1994

Related U.S. Application Data

[63] Continuation-in-part of Ser. No. 18,890, Feb. 17, 1993, abandoned.

[51] Int. Cl.[6] ..... A45D 24/36

[52] U.S. Cl. ..... 132/214; D28/44; 30/124

[58] Field of Search ..... 132/271, 213, 213.1, 132/214; D28/10, 44; 30/124, 233

[56] References Cited

U.S. PATENT DOCUMENTS

| | | | |
|---|---|---|---|
| 1,182,242 | 5/1916 | Bennett | 132/214 |
| 1,583,540 | 5/1926 | Evans | 132/214 |
| 1,853,828 | 4/1932 | Mani | 132/214 |
| 3,877,472 | 4/1975 | P'Angelo | 132/145 |
| 3,894,548 | 7/1975 | Suvino | 132/214 |
| 4,414,991 | 11/1983 | Marlotte | 132/214 |
| 4,520,565 | 6/1985 | Maggiore | 132/214 |

FOREIGN PATENT DOCUMENTS

| | | | |
|---|---|---|---|
| 2666207 | 3/1992 | France | 132/214 |

*Primary Examiner*—John G. Weiss
*Attorney, Agent, or Firm*—William Nitkin

[57] ABSTRACT

A hair-cutting guide having two interconnected plate members which align to compress and sandwich hair therebetween to be cut along an edge of the aligned plate members.

13 Claims, 4 Drawing Sheets

HAIR-CUTTING GUIDE

This application is a continuation-in-part of my previous application entitled Hair-cutting Guide, Ser. No. 08/018,890 filed Feb. 17, 1993, now abandoned.

BACKGROUND OF THE INVENTION

1. Field of the Invention

The device of this invention resides in the area of hair-cutting guides and more particularly relates to a device having two interconnected plate members which align to retain and sandwich hair therebetween to be cut along an edge of the plate members, such edge being straight or curved.

2. Description of the Prior Art

In the prior art when cutting hair, one can grasp the hair between the fingers and cut off the length of hair that protrudes below the fingers in a generally straight line. Many hair styles, however, require exact straight lines, for example, in order to achieve the desired effect. Hairstylists who attempt to cut hair freehand in a straight or curved line may not succeed in obtaining the exact geometric straight or curved line desired.

Hair-cutting guides exist in the prior art such as U.S. Pat. No. 4,520,565 to Maggiore to cut hair from the top of the head at a specified distance from the scalp. Also hair-bobbing gauges exist such as disclosed in U.S. Pat. No. 1,182,242 to Bennett and U.S. Pat. No. 1,583,540 to Evans, but these gauges are used to cut hair along a straight line at the neck line and curve partially around the head such that they cannot be disposed to make angular cuts around the sides of the subject's hair.

SUMMARY OF THE INVENTION

It is an object of this invention to provide a hair-cutting guide for the accurate cutting of hair in a straight line in one embodiment and in a curved line in a second embodiment. To this end dual, elongated, parallel, planar first and second plate members, each having a first and second edge, and each having the same general size and shape, are pivotally attached at one end to a handle member by adjustable pivot means. These plate members can move adjacent to one another so that their respective first and second edges can be aligned to form first and second parallel straight cutting edges if the first and second edges are straight or first and second curved cutting edges if the first and second edges are curved. After a portion of the subject's hair is sandwiched between the plate members and the pivot means adjusted to compress and flatten the hair, the hairstylist passes a cutter, either a scissors or an electric cutter, along the first or second edge of the aligned plate members, cutting the hair off at the desired length and achieving a straight, curved or other shaped hair cut line depending on the shape of the plate members used. The subject's hair can be cut at many angles and positions around the back, sides and front as the guide of this invention, being disposed in a short, flat, planar configuration, can easily be moved to any desired angle or position for cutting.

DESCRIPTION OF THE PREFERRED EMBODIMENT(S)

Figure 1:
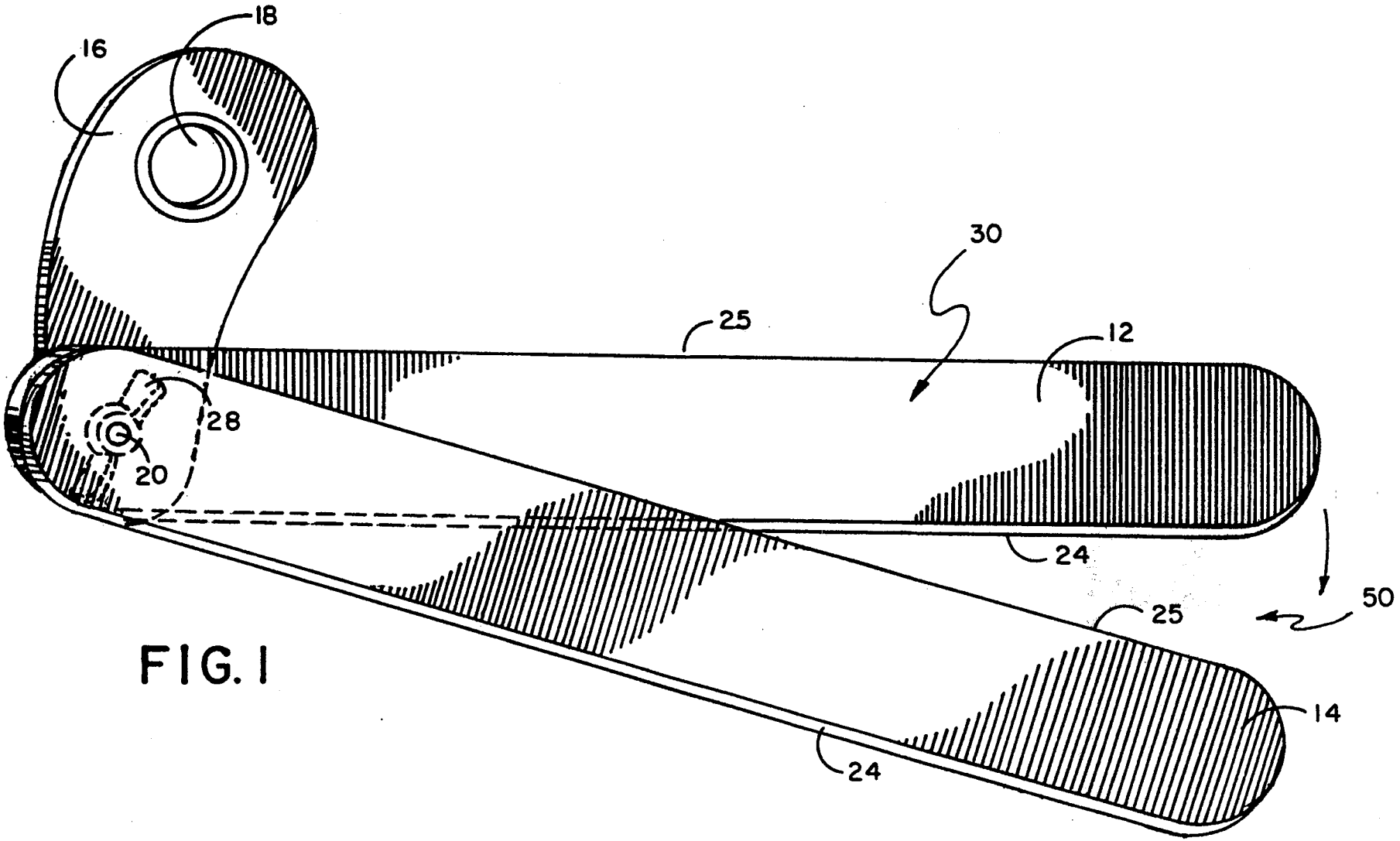
FIG. 1 illustrates a perspective view of the straight line hair-cutting guide member of this invention.

FIG. 1 illustrates a perspective view of the hair-cutting guide of this invention for cutting hair in a straight line. Shown are planar first plate member 12 and planar second plate member 14, being of the same size and shape, which plate members are positioned adjacent to one another and attached at one end to each other and to handle 16 by a perpendicularly disposed pivot, such as by pivot bolt 20 on which is threaded, in a preferred embodiment, wing nut 28. Other equivalent pivot means, such as rivets or equivalent, can be utilized to enable the plate members and handle to rotate on said pivot in and out of parallel alignment and in general contact with one another. Handle 16 can be slightly elongated and curved and have an aperture 18 formed therein to aid in grasping handle 16. First and second plate members 12 and 14 each have a first and second edge 24 and 25 along selected of which edges, when the plate members are aligned, the hair can be cut. In a preferred embodiment the plate members can be approximately 6 inches to 10 inches in length to allow for easy angular positioning around the subject's head. The plate members can further be approximately 1 inch high to adequately sandwich the hair and flatten the hair therebetween.

Figure 2:
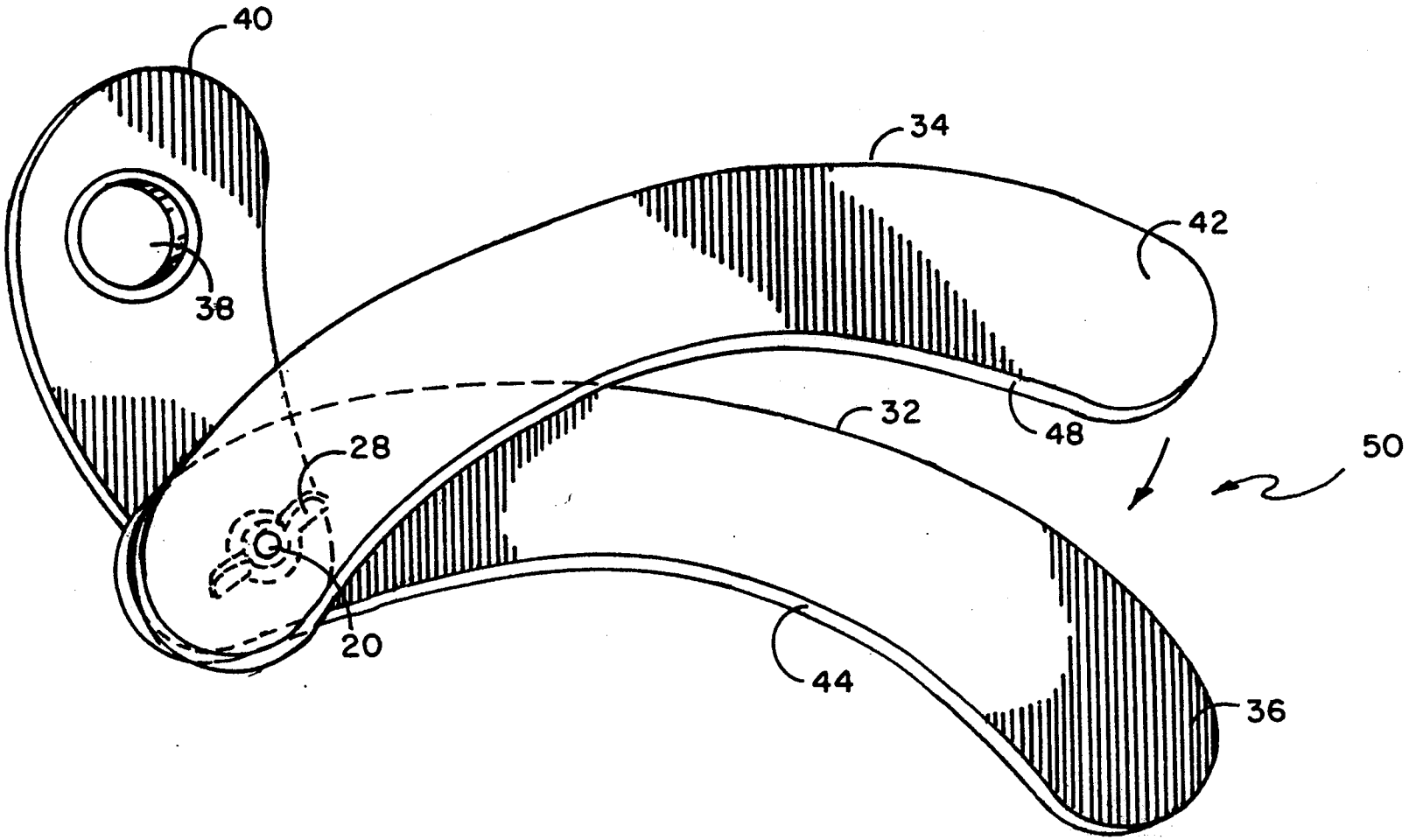
FIG. 2 illustrates a perspective view of an alternate embodiment of the guide member in use wherein the plate members are curved.

FIG. 2 illustrates a perspective view of an alternate embodiment of the hair-cutting guide of this invention. Curved first plate member 36 and curved second plate member 42 are pivotally attached to handle 40 by pivotal bolt 20 also held by wing nut 28. These curved plate members have two convex curved cutting edges being convex curved edge 34 of curved second plate member 42 and convex curved edge 32 of curved first plate member 36. Concave edge 44 of curved first plate member 36 and concave edge 48 of curved second plate member 42 provide a second pair of curved cutting edges. Pivotal bolt 20 and wing nut 28 can be tightened to tighten curved first plate member 36 and curved second plate member 42 together to provide for compressing and flattening the hair placed between the curved first and second plate members. Tension provided from pivotal bolt 20 can be increased or lessened by either tightening or loosening wing nut 28 as seen in FIGS. 1 and 2. Curved handle 40 can have an aperture 38 at one end thereof for passing a finger therethrough for ease in grasping and controlling the hair-cutting guide.

Figure 3:
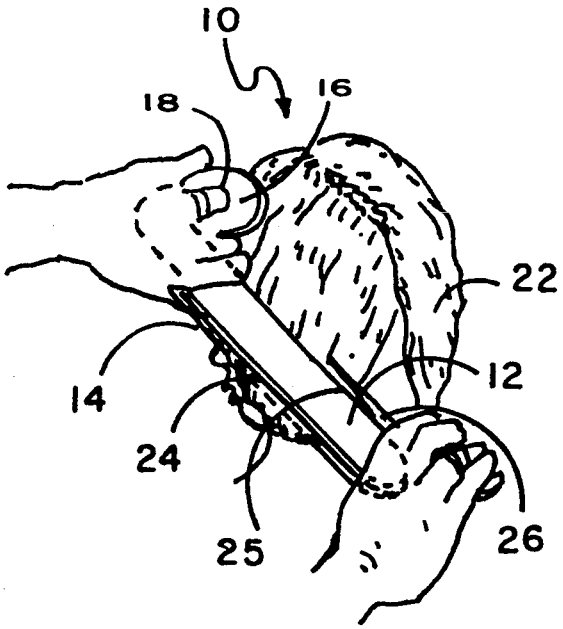
FIG. 3 illustrates a perspective view of the guide member of FIG. 1 in use.

FIG. 3 illustrates a perspective view of the hair-cutting guide of FIG. 1 in use. A portion of hair 22 of subject 10 is placed between first plate member 12 and second plate member 14 which members sandwich and somewhat spread out the portion of hair due to the plate members being urged together by the tightness of pivot bolt 20 and wing nut 28. Wing nut 28 can be adjusted to achieve the desired tension between first and second plate members 12 and 14. The guide member can be positioned by the hairstylist so that the hair above second straight edge 25 of first and second plate members 12 and 14 can be cut off by scissors 26 or an electric hair cutter as it is passed against the upwardly facing second straight edge 25 of the plate members, enabling the hair to be cut in a desired straight line. The hairstylist could also cut the hair along downwardly facing first edge 24 of the hair-cutting guide. The guide can be used by either right-handed or left-handed individuals wherein the guide would be usually held in the user's non-dominant hand. The guide of this invention can be used with either its first or second edges facing upwards and with the handle extending upwards or downwards depending on how the hairstylist grasps and holds the guide. The guide, as illustrated in FIG. 3, is grasped by handle 40 and held in the hairstylist's left hand. If the guide were reversed, it would work just as well with handle 40 being held within the hairstylist's right hand. Handles 16 and 40 are curved to allow for easy grasping thereof, and the handles also pivot so that they can be placed in a variety of positions for easy grasping by the hairstylist. The first and second straight edges of the first and second plate members can be utilized to achieve many different hairstyling effects on a subject's hair as desired by the subject and the hairstylist.

Figure 4:
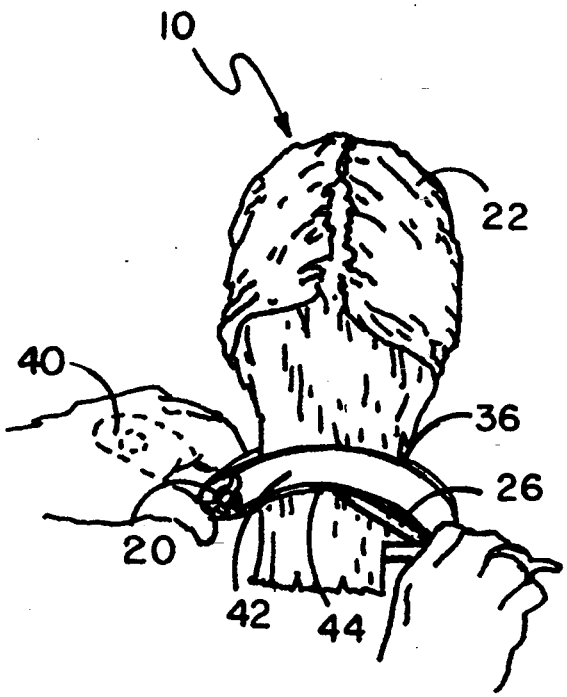
FIG. 4 illustrates a perspective view of the guide member of FIG. 2 in use.

FIG. 4 illustrates a perspective view of the guide of FIG. 2 in use. The hairstylist is holding the guide by handle 40. A portion of hair 22 has been passed between curved first and second plate members 36 and 42 to be retained and flattened by the tension of the plates forced together by the pivot means, and the hairstylist is cutting the portion of hair along concave edge 44 with cutter 26. Not only can the curved embodiment of the device of this invention be reversed so that it can be used by right-handed and left-handed individuals, but also the device can be inverted to yield at least two different curved lines being concave and convex shaped hair cut guide lines. In FIG. 4, the subject's hair is being cut along concave bottom edges 44 and 48 wherein the curve is aimed downward, being lower at its outer sides and higher at its center. If the guide were inverted and the subject's hair placed within the curved plate members, the resulting cut would be in a convex shape being higher at its outer sides and lower at its center. It should be noted that the first and second edges of the first and second plate members are not limited to a straight or curved edge but can take other shapes, such as a scalloped shape, to achieve other desired hairstyle effects.

Figure 5:
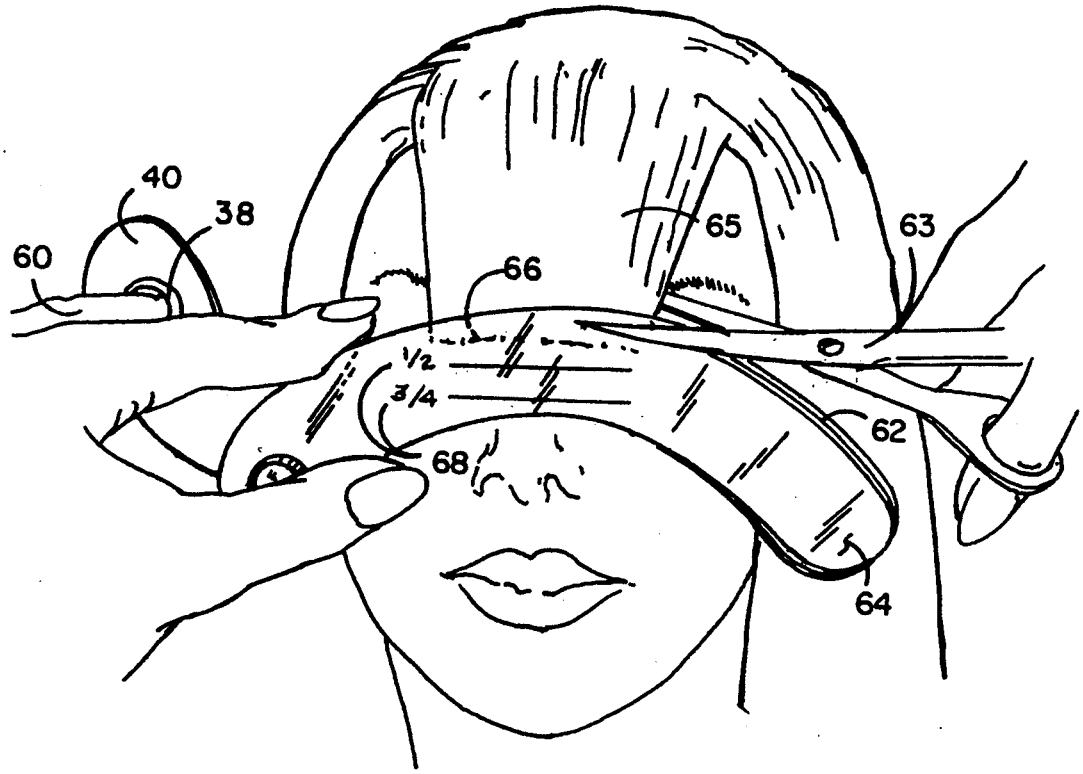
FIG. 5 illustrates a front view of the guide member having a transparent first plate member.

The hair-cutting guide of his invention is especially useful in cutting hair located on the front, sides and back of the head as seen in FIGS. 3, 4 and 5. Designs can be cut in the subject's hair on the front, sides and back of the head to create a variety of hair styles which go beyond merely cutting a straight, generally collar-length hair line or bob across the back of the subject's neck as accomplished by prior art devices. The device of this invention is especially useful because its short, straight or slightly curved planar construction can be used to cut at a plurality of different angles because of the hairstylist's ability to easily move the guide of this invention at such various angles around the sides, rear and front of the subject's head to create either angular cuts, feathering or layered effects.

FIG. 5 illustrates an alternate embodiment of this invention utilizing a transparent second plate member 64. Hair 65 is sandwiched between rear first plate member 62 and transparent second plate member 64 facing the user. The ends 66 of hair are visible through transparent second plate member 64 so that the user of the guide knows exactly how much hair is being removed when cutting with scissors 63. Further, indicia such as lines can be printed on transparent second plate member 64 with measurements 68 such as ¼ inch, ½ inch and ¾ inch imprinted thereon so that more exact measurements can be made as to how much hair is being removed when it is sandwiched between the plate members. In FIG. 5 the user of the device of this invention has passed her middle finger 60 through aperture 38 in handle 40. Handle 40 can be rotatably pivoted in parallel relation to the first and second plate members to a variety of positionings wherein one of such positional is selected as being most comfortable to the user depending on the desired angle of the cut and the size and positioning of the user's hand.

The hair-cutting guide of this invention can be made of material which is flexible or rigid, sturdy and non-rusting, such as plastic, aluminum, stainless steel or equivalent.

Although the present invention has been described with reference to particular embodiments, it will be apparent to those skilled in the art that variations and modifications can be substituted therefor without departing from the principles and spirit of the invention.

I claim:

1. A hair-cutting guide utilized by a user in cutting the hair of a subject, comprising:

a first elongated planar plate member having a first end and first and second edges, said first and second edges of said first plate member disposed in parallel relationship to each other;

a second elongated planar plate member having a first end and first and second edges, said first and second edges of said second plate member disposed in parallel relationship to each other wherein said first edges of said first and second plate members form a first cutting edge and said second edges of said first and second plate members form a second cutting edge when said plate members are positioned adjacent to one another in parallel alignment and sandwiched together, said first plate member being in parallel planar relationship to said second plate member; and adjustably tightenable pivot means disposed at said first ends of said first and second plate members, said pivot means disposed perpendicular to the plane of said first and second planar plate members, said pivot means holding said first and second plate members together for said hair to be placed between said first and second plate members when said first and second plate members are rotated out of alignment on said pivot means, said hair to be sandwiched between said first and second plate members when said first and second plate members are rotated back into alignment by said user, said hair to be cut with cutting means along a selected one of said pairs of first and second aligned cutting edges in a line corresponding to the shape of the pair of aligned cutting edges of said first and second plate members.

2. The guide of claim 1 wherein said first and second edges of said first and second plate members are straight to produce a straight line haircut.

3. The guide of claim 1 wherein said first and second edges of said first and second plate members are curved to produce a curved line haircut.

4. The guide of claim 2 further including a planar handle member having a first end and a second end, said handle member disposed adjacent, and in parallel planar relationship, to one of said plate members, said handle member pivotally attached at its first end to said first and second plate members by said pivot means and rotatable in parallel alignment with said first and second plate members.

5. The guide of claim 3 further including a planar handle member having a first end and a second end, said handle member disposed adjacent, and in parallel planar relationship, to one of said plate members, said handle member pivotally attached at its first end to said first and second plate members by said pivot means and rotatable in parallel alignment with said first and second plate members.

6. The guide of claim 4 further including an aperture defined in said handle member neat said second end thereof for ease in grasping said handle member.

7. The guide of claim 5 further including an aperture defined in said handle member near said second end thereof for ease in grasping said handle member.

8. The guide of claim 6 wherein said second plate member is transparent for said user to view the length of said hair sandwiched between said first and second plate members, said second plate member positioned to face said user.

9. The guide of claim 7 wherein said second plate member is transparent for said user to view the length of said hair sandwiched between said first and second plate members, said second plate member positioned to face said user.

10. The guide of claim 8 further including indicia indicating measurement from either said first cutting edge or said second cutting edge, said indicia disposed on said transparent second plate member.

11. The guide of claim 9 further including indicia indicating measurement from either said first cutting edge or said second cutting edge, said indicia disposed on said transparent second plate member.

12. The guide of claim 10 wherein said first and second plate members are of the same size and shape and are each approximately 6 inches to 10 inches in length and approximately 1 inch in height.

13. The guide of claim 11 wherein said first and second plate members are of the same size and shape and are each approximately 6 inches to 10 inches in length and approximately 1 inch in height.

* * * * *